US011136998B2

(12) United States Patent
Behnke et al.

(10) Patent No.: US 11,136,998 B2
(45) Date of Patent: Oct. 5, 2021

(54) VERTICAL PUMP HAVING SELF-COMPENSATING THRUST BALANCE DEVICE

(71) Applicant: ITT MANUFACTURING ENTERPRISES LLC., Wilmington, DE (US)

(72) Inventors: Paul Walter Behnke, Newport Coast, CA (US); Daniel Stephen Miller, Ontario, CA (US); Abhi Nutankumar Gandhi, South Pasadena, CA (US)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 139 days.

(21) Appl. No.: 16/263,613

(22) Filed: Jan. 31, 2019

(65) Prior Publication Data

US 2020/0248716 A1 Aug. 6, 2020

(51) Int. Cl.
*F04D 29/046* (2006.01)
*F04D 29/66* (2006.01)
(Continued)

(52) U.S. Cl.
CPC ..... *F04D 29/661* (2013.01); *F04D 29/046* (2013.01); *F04D 29/0416* (2013.01); *F04D 29/051* (2013.01)

(58) Field of Classification Search
CPC ... F04D 29/041; F04D 29/0416; F04D 29/047
See application file for complete search history.

(56) References Cited

U.S. PATENT DOCUMENTS 3,549,277 A * 12/1970 Howard ..... F02M 37/10 417/321
4,240,762 A * 12/1980 Lobanoff ..... F04D 29/044 403/24

(Continued)

FOREIGN PATENT DOCUMENTS

DE 954756 C 12/1956
EP 0694696 A1 1/1996

(Continued)

OTHER PUBLICATIONS

English translation of DE954756C (Year: 1956).*

(Continued)

*Primary Examiner* — David E Sosnowski
*Assistant Examiner* — Wesley Le Fisher
(74) *Attorney, Agent, or Firm* — Carter, DeLuca & Farrell LLP; George Likourezos; Bret P. Shapiro

(57) ABSTRACT

A vertical pump features a shaft having an end with an impeller arranged thereon and rotates about an axis; a stationary bushing having an axial bushing surface, a radial bushing surface, and a central bushing bore; and a thrust balance drum that includes a central balancing drum bore to receive the shaft, that couples to the shaft so as to rotate about the axis, that includes an axial balance drum surface and a radial balance drum surface, and that is arranged in the central bushing bore of the stationary bushing with the axial balance drum surface positioned with respect to the axial bushing surface to define an axial clearance, and with the radial balance drum surface positioned with respect to the radial bushing surface to define a radial clearance. In operation, the thrust balance drum balances thrust loads produced by the impeller.

20 Claims, 1 Drawing Sheet

(51) Int. Cl.
*F04D 29/051* (2006.01)
*F04D 29/041* (2006.01)

(56) References Cited

U.S. PATENT DOCUMENTS

| | | | | |
|---|---|---|---|---|
| 5,613,831 | A * | 3/1997 | Liegat | F04D 29/041 415/229 |
| 2015/0226219 | A1* | 8/2015 | Johnson | F04D 13/10 417/423.3 |
| 2018/0355879 | A1* | 12/2018 | Huber | F04D 1/06 |
| 2020/0011332 | A1* | 1/2020 | Hill | F04D 29/044 |
| 2020/0080562 | A1* | 3/2020 | Knapp | F04D 29/046 |

FOREIGN PATENT DOCUMENTS

| | | | |
|---|---|---|---|
| FR | 876247 | A | 10/1942 |
| JP | S58211595 | A | 12/1983 |

OTHER PUBLICATIONS

Vasant Godbole et al., "Axial Thrust in Centrifugal Pumps—Experimental Analysis" Kirloskar Brothers Ltd., 15th International Conference on Experimental Mechanics (Year: 2012).*

International Preliminary Report on Patentability dated Jul. 27, 2021 for corresponding International PCT Application Mo. PCT/US2020/016224.

* cited by examiner

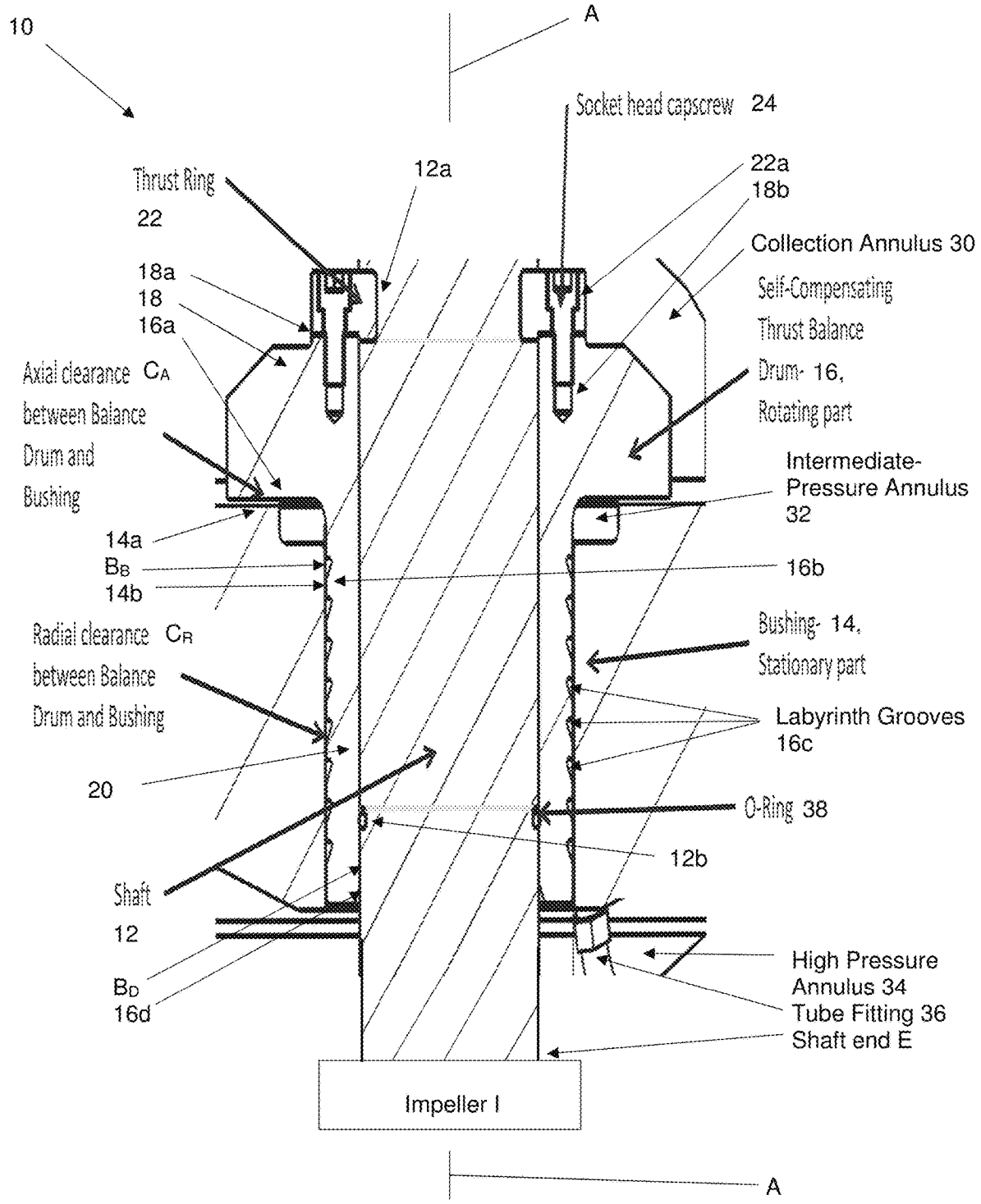
Thrust Balance Drum or Device

VERTICAL PUMP HAVING SELF-COMPENSATING THRUST BALANCE DEVICE

BACKGROUND OF THE INVENTION

1. Field of the Invention

The present invention relates to a vertical pump.

2. Brief Description of Related Art

Vertical pumps produce axial thrusts on the pump's rotor. Appropriate thrust bearings are selected to withstand the entire rotor weight and the hydraulic thrust load produced by impellers producing the head in the vertical pumps. High axial thrusts can limit the head produced by the impellers in the vertical pumps.

SUMMARY OF THE INVENTION

A Vertical Pump

According to some embodiments, the present invention may include, or take the form of, a new and unique vertical pump featuring a shaft, a stationary bushing and a self-compensating thrust balance device or drum.

The shaft may include an end with an impeller arranged thereon and configured to rotate about an axis.

The stationary bushing may include an axial bushing surface and a radial bushing surface, and may be configured with a central bushing bore.

The thrust balance drum may be configured with a central balancing drum bore to receive the shaft, and may be configured to couple to the shaft so as to rotate with the shaft about the axis. The thrust balance drum may include an axial balance drum surface and a radial balance drum surface, and may be arranged in the central bushing bore of the stationary bushing with the axial balance drum surface positioned with respect to the axial bushing surface to define an axial clearance, and with the radial balance drum surface positioned with respect to the radial bushing surface to define a radial clearance. The thrust balance drum operates to balance thrust loads produced by the impeller.

Apparatus Having Rotating and Stationary Parts

According to some embodiments, the present invention may take the form of apparatus featuring at least one rotating part configured to rotate about an axis; at least one stationary part having an axial stationary surface and a radial stationary surface, and being configured with a central stationary bore; and a thrust balance drum configured with a central balancing drum bore to receive the at least one rotating part, being configured to couple to the at least one rotating part so as to rotate about the axis, having an axial balance drum surface and a radial balance drum surface, and being in the central stationary bore of the at least one stationary part with the axial balance drum surface positioned with respect to the axial stationary surface to define an axial clearance, and with the radial balance drum surface positioned with respect to the radial stationary surface to define a radial clearance, the thrust balance drum operating to balance thrust loads produced by the at least one rotating part.

According to some embodiments, the present invention may take the form of apparatus featuring at least one rotating part, at least one stationary part and a thrust balance drum.

The at least one rotating part may be configured as a shaft having an end with an impeller arranged thereon to rotate about an axis. The at least one stationary part may be configured as a stationary bushing having an axial bushing surface and a radial bushing surface, and may also be configured with a central bushing bore. The thrust balance drum may be configured with a central balancing drum bore to receive the shaft, and may also be configured to couple to the shaft so as to rotate about the axis. The thrust balance drum may include an axial balance drum surface and a radial balance drum surface, and may be arranged in the central bushing bore of the stationary bushing with the axial balance drum surface positioned with respect to the axial bushing surface to define an axial clearance, and with the radial balance drum surface positioned with respect to the radial busing surface to define a radial clearance. The thrust balance drum operates to balance axial thrust loads produced by the impeller.

BRIEF DESCRIPTION OF THE DRAWING

The drawing includes FIG. 1, which is not necessarily drawn to scale:

FIG. 1 is a diagram of a thrust balancing drum, according to some embodiments of the present invention.

DETAILED DESCRIPTION OF THE INVENTION

In summary, a new and unique self-compensating thrust balance drum or device is disclosed herein which operates with controlled radial and axial clearances ($C_R$, $C_A$) between rotating and stationary parts. The variable radial and axial clearances enables the self-compensating thrust balance device to eliminate thrust load produced by the pump impellers on the thrust bearing. In operation, the self-compensating thrust balance device continuously and automatically adjusts its position to balance the thrust loads produced by the impellers at all pump operating conditions and for all liquids pumped.

In particular, and consistent with that described in further detail below, when impellers generate increased hydraulic thrust, the axial clearance $C_A$ reduces due to the axial thrust load transmitted through the pump's shaft. When the axial clearance $C_A$ is closed, flow through it is restricted and pressure increases in the pump's intermediate-pressure annulus between the thrust balance drum and the pump's stationary bushing. The increased pressure acts on the drum face of the thrust balance drum to create a counteracting force opposed to the impeller thrust load. The inverse is also true. As the impeller thrust load decreases, the axial clearance $C_A$ is increased resulting in lower intermediate pressure and thereby the drum counteracting force is reduced. Through its changing axial position in response to the impeller thrust load, the thrust balance drum acts to stabilize the impeller thrust load carried by the pump's external thrust bearing. This self-compensating behavior is highly desirable for providing a reliable axial thrust bearing operation without substantially increasing the cost of the pump's bearing and supporting components.

FIG. 1 shows part of a vertical pump generally indicated as 10, including at least one rotating part like a shaft 12, at least one stationary part like a stationary bushing 14 and a thrust balance device or drum 16, according to some embodiments.

The shaft 12 may include an end E with an impeller I arranged thereon and may be configured to rotate about an axis A.

The stationary bushing 14 may include an axial bushing surface 14*a* and a radial bushing surface 14*b* and may also be configured with a central bushing bore generally indicated by the reference label $B_B$, e.g., consistent with that shown in FIG. 1.

The thrust balance device or drum 16 may be configured with a central balancing drum bore generally indicated by the reference label $B_D$ to receive the shaft 12, and may also be configured to couple to the shaft 12 so as to rotate with the shaft 12 about the axis A, e.g., consistent with that shown in FIG. 1 and described below. The thrust balance device or drum 16 may include an axial balance drum surface 16*a* and a radial balance drum surface 16*b*. The thrust balance device or drum 16 may be arranged in the central bushing bore $B_B$ of the stationary bushing 14 with the axial balance drum surface 16*a* positioned with respect to the axial bushing surface 14*a* to define an axial clearance $C_A$, and with the radial balance drum surface 16*b* positioned with respect to the radial bushing surface 14*b* to define a radial clearance $C_R$. The thrust balance drum 16 operates to balance thrust loads produced by the impeller I, e.g., consistent with that shown in FIG. 1. By way of example, the thrust loads produced by the impeller I may include axial loads.

The thrust balance drum 16 may include a flange portion 18, e.g., configured to extent radially and outwardly above the axial bushing surface 14*a* consistent with that shown in FIG. 1. The flange portion 18 may include the axial balance drum surface 16*a*, e.g., formed by a lower ring-like surface as shown. The flange portion 18 is configured with a portion of the central balancing drum bore $B_D$ formed therein.

The thrust balance drum 16 may also include a cylindrical portion 20, e.g., configured between the shaft 12 and the radial bushing surface 14*b* consistent with that shown in FIG. 1. The cylindrical portion 20 may include the radial balance drum surface 16*b*, e.g., formed by an outer cylindrical surface as shown. The cylindrical portion 20 may also be configured with a corresponding portion of the central balancing drum bore $B_D$, e.g., so the central balancing drum bore $B_D$ is formed as an opening axially through the thrust balance drum 16.

The radial balance drum surface 16*b* may be configured with one or more labyrinth grooves 16*c* to reduce volumetric flow through the thrust balance drum 16, e.g., including to enhance pump performance by reducing volumetric flow in the radial clearance $C_R$ between the radial balance drum surface 16*b* and the radial bushing surface 14*b*. By way of example, the labyrinth grooves 16*c* may be wholly or partially circumferentially cut, scored or formed about the radial balance drum surface 16*b*, e.g., having a particular size, shape, contour, depth, number of, and/or axial spacing. In FIG. 1, and by way of example, the radial balance drum surface 16*b* may be configured with eight labyrinth grooves 16*c*. Moreover, the vertical pump disclosed herein is not intended to be limited to the labyrinth grooves 16*c* having any particular size, shape, contour, depth, number, or axial spacing; and embodiments are envisioned using labyrinth grooves having different sizes, different shapes, different contours, different depths, a different number of, or a different axial spacing thereof, e.g., depending on the particular application. Furthermore, it is important to note that the labyrinth grooves 16*c* are not necessary per se to the implementation of the vertical pump disclosed herein. For example, embodiments are envisioned, implementing the vertical pump without the labyrinth grooves 16*c*.

By way of example, the shaft 12 and the thrust balance drum 16 may be configured to couple together and rotate as follows: The vertical pump 10 may include a thrust ring 22 and at least one threaded fastener 24. The thrust ring 22 may include at least one aperture 22*a* formed therein to receive the at least one threaded fastener 24. The shaft 12 may be configured with a circumferential groove 12*a* to receive the thrust ring 22. The flange portion 18 may include a top surface 18*a* having at least one threaded aperture 18*b* formed therein to receive the at least one threaded fastener 24 passing through the at least one aperture 22*a* of the thrust ring 22, so as to couple the thrust ring 22 to the flange portion 18 of the thrust balance drum 16 and to couple together the thrust balance drum 16 to the shaft 12 to rotate, e.g., consistent with that shown in FIG. 1. The at least one threaded fastener 24 may include a socket head capscrew, e.g., consistent with that shown in FIG. 1. However, the implementation of the vertical pump is not intended to be limited to how the shaft 12 is coupled to the thrust balance device or drum 16. Another embodiment may include coupling together the shaft 12 and the thrust balance device or drum 16, e.g., using other types or kinds of coupling techniques either now known or later developed in the future.

A collection annulus 30, inside the pump pressure casing, collects liquid discharging from the thrust balance drum 16.

An intermediate-pressure annulus 32, an open space between the thrust balance drum 16 and the stationary bushing 14, is pressurized by the action of the self-compensating thrust balance drum 16.

A high-pressure annulus 34, an open space between the stationary bushing 14 and a last-stage impeller, distributes liquid to enter the self-compensating thrust balance drum 16.

A tube fitting 36 may be used for development test purposes.

An O-ring 38 is configured in a lower circumference groove 12*b* of the shaft 12 between the shaft 12 and an inner cylindrical drum surface 16*d* of the self-compensating thrust balance drum 16.

The Scope of the Disclosure

It should be understood that, unless stated otherwise herein, any of the features, characteristics, alternatives or modifications described regarding a particular embodiment herein may also be applied, used, or incorporated with any other embodiment described herein.

Although this disclosure sets forth exemplary embodiments, various other additions and omissions may be made therein and thereto without departing from the spirit and scope of that disclosed herein.

What is claimed is:

1. A vertical pump comprising:

a shaft having an end with an impeller arranged thereon and configured to rotate about an axis and the shaft is configured with a circumferential groove to receive a thrust ring;

a stationary bushing having an axial bushing surface and a radial bushing surface, and being configured with a central bushing bore;

the thrust ring, wherein the thrust ring includes a fastener which attaches the thrust ring to a thrust balance drum; and the thrust balance drum configured with a central balancing drum bore to receive the shaft, being configured to couple to the thrust ring so as to rotate with the shaft about the axis, having an axial balance drum surface and a radial balance drum surface, and being arranged in the central bushing bore of the stationary bushing with the axial balance drum surface positioned with respect to the axial bushing surface to define an axial clearance, and with the radial balance drum surface positioned with respect to the radial bushing surface to define a radial clearance, the thrust balance drum operating to balance thrust loads produced by the impeller.

2. A vertical pump according to claim 1, wherein the thrust balance drum comprises a flange portion and a cylindrical portion, the flange portion having the axial balance drum surface, and the cylindrical portion having the radial balance drum surface.

3. A vertical pump according to claim 2, wherein the flange portion is configured to extent radially and outwardly above the axial bushing surface.

4. A vertical pump according to claim 2, wherein the cylindrical portion is configured between the shaft and the radial bushing surface.

5. A vertical pump according to claim 2, wherein the thrust ring includes at least one threaded fastener and at least one aperture configured therein to receive the at least one threaded fastener;

and the flange portion comprises a top surface having at least one threaded aperture configured therein to receive the at least one threaded fastener passing through the at least one aperture of the thrust ring to couple the thrust ring to the flange portion so as to couple the thrust balance drum to the shaft.

6. A vertical pump according to claim 5, wherein the at least one threaded fastener comprises a socket head capscrew.

7. A vertical pump according to claim 1, wherein the radial balance drum surface is configured with one or more labyrinth grooves to reduce volumetric flow through the thrust balance drum.

8. A vertical pump according to claim 1, wherein the thrust loads include axial loads.

9. Apparatus comprising:

at least one rotating part configured to rotate about an axis and with a circumferential groove to receive a thrust ring;

at least one stationary part having an axial stationary surface and a radial stationary surface, and being configured with a central stationary bore;

the thrust ring, wherein the thrust ring includes a fastener which attaches the thrust ring to a thrust balance drum; and the thrust balance drum configured with a central balancing drum bore to receive the at least one rotating part, being configured to couple to the thrust ring so as to rotate about the axis, having an axial balance drum surface and a radial balance drum surface, and being arranged in the central stationary bore of the at least one stationary part with the axial balance drum surface positioned with respect to the axial stationary surface to define an axial clearance, and with the radial balance drum surface positioned with respect to the radial stationary surface to define a radial clearance, the thrust balance drum operating to balance thrust loads produced by the at least one rotating part.

10. Apparatus according to claim 9, wherein the at least one rotating part comprises a shaft having an end with an impeller arranged thereon and configured to rotate about the axis.

11. Apparatus according to claim 10, wherein the thrust balance drum is configured to couple to the shaft so as to rotate about the axis.

12. Apparatus according to claim 9, wherein the at least one stationary part comprises a stationary bushing having an axial bushing surface and a radial bushing surface, and being configured with a central bushing bore.

13. Apparatus according to claim 12, wherein the thrust balance drum is arranged in the central bushing bore of the stationary bushing with the axial balance drum surface positioned with respect to the axial bushing surface to define the axial clearance, and with the radial balance drum surface positioned with respect to the radial bushing surface to define the radial clearance.

14. Apparatus according to claim 9, wherein the at least one rotating part comprises a shaft having an end with an impeller arranged thereon and configured to rotate about the axis; and the at least one stationary part comprises a stationary bushing having an axial bushing surface and a radial bushing surface, and being configured with a central bushing bore.

15. Apparatus according to claim 14, wherein the thrust balance drum is configured to couple to the shaft so as to rotate about the axis; and the thrust balance drum is arranged in the central bushing bore of the stationary bushing with the axial balance drum surface positioned with respect to the axial bushing surface to define the axial clearance, and with the radial balance drum surface positioned with respect to the radial bushing surface to define the radial clearance.

16. Apparatus according to claim 9, wherein the thrust loads include axial loads.

17. Apparatus according to claim 9, wherein the thrust balance drum comprises a flange portion and a cylindrical portion, the flange portion having the axial balance drum surface, and the cylindrical portion having the radial balance drum surface.

18. Apparatus according to claim 9, wherein the radial balance drum surface is configured with one or more labyrinth grooves to reduce volumetric flow through the thrust balance drum.

19. Apparatus according to claim 9, wherein the apparatus comprises a vertical pump.

20. Apparatus comprising:

at least one rotating part being configured as a shaft having an end with an impeller arranged thereon to rotate about an axis and the rotating part is configured with a circumferential groove to receive a thrust ring;

at least one stationary part being configured as a stationary bushing having an axial bushing surface and a radial bushing surface, and also being configured with a central bushing bore;

the thrust ring, wherein the thrust ring includes a fastener which attaches the thrust ring to a thrust balance drum; and the thrust balance drum configured with a central balancing drum bore to receive the shaft, being configured to couple to the thrust ring so as to rotate about the axis, having an axial balance drum surface and a radial balance drum surface, and being arranged in the central bushing bore of the stationary bushing with the axial balance drum surface positioned with respect to the axial bushing surface to define an axial clearance, and with the radial balance drum surface positioned with respect to the radial busing surface to define a radial clearance, the thrust balance drum operating to balance axial loads produced by the impeller.

* * * * *